United States Patent [19]

Symon

[11] Patent Number: 4,667,380

[45] Date of Patent: May 26, 1987

[54] APPARATUS FOR INTERLACING A MULTI-FILAMENT YARN

[75] Inventor: Georg Symon, Winterthur, Switzerland

[73] Assignee: Rieter Machine Works Limited, Winterthur, Switzerland

[21] Appl. No.: 907,390

[22] Filed: Sep. 15, 1986

Related U.S. Application Data

[62] Division of Ser. No. 680,526, Dec. 11, 1984, Pat. No. 4,631,791.

[30] Foreign Application Priority Data

Dec. 20, 1983 [CH] Switzerland ..... 6772/83

[51] Int. Cl.[4] ..... D02J 1/08; D02G 1/16

[52] U.S. Cl. ..... 28/271; 28/274; 28/276; 57/333; 57/350

[58] Field of Search ..... 28/271, 272, 274, 275, 28/276; 57/333, 350

[56] References Cited

U.S. PATENT DOCUMENTS 3,823,450 7/1974 Ankudowicz et al. ..... 28/272
4,245,378 1/1981 Price .

FOREIGN PATENT DOCUMENTS 1523271 3/1968 France .
48-33424 10/1973 Japan ..... 28/276

*Primary Examiner*—Robert R. Mackey
*Attorney, Agent, or Firm*—Werner W. Kleeman

[57] ABSTRACT

The apparatus for interlacing a multi-filament yarn within an interlacing passage comprises a body member containing at least one substantially spherical recess for receiving a substantially spherical air jet or blow nozzle element selectively movable in predetermined directions to provide two-dimensional adjustability thereof. Due to this selective movability of the substantially spherical air jet or blow nozzle element, there exists the possibility of controllably moving the air stream issuing from the air jet or blow nozzle element so as to interlace the filaments of the multi-filament yarn. The air stream can be moved within a predetermined operating range in order to thereby optimize the interlacing of the multi-filament yarn.

4 Claims, 9 Drawing Figures

APPARATUS FOR INTERLACING A MULTI-FILAMENT YARN

CROSS REFERENCE TO RELATED APPLICATION

This application is a divisional application of the commonly assigned, copending U.S. patent application Ser. No. 06/680,526, filed Dec. 11, 1984 now U.S. Pat. No. 4,631,791 granted Dec. 30, 1986, and entitled: "APPARATUS FOR INTERLACING A MULTI-FILAMENT YARN".

BACKGROUND OF THE INVENTION

The present invention broadly relates to a new and improved apparatus for interlacing a multi-filament yarn.

Generally speaking, the apparatus for interlacing a multi-filament yarn is of the type comprising an interlacing passage or channel and at least one air jet or blow nozzle opening at substantially right angles or at an inclination with respect to such interlacing passage or channel for infeeding a pressurized fluid medium, typically a jet of air, although other fluid mediums can be used, such as for instance steam.

Multi-filament yarns are interlaced in some cases in order to obtain entanglement of the individual filaments thereof. This entanglement occurs locally or continually and has the advantage of affording a better coherence of the multi-filament yarn for the subsequent operating processing stages.

Interlacing of multi-filament yarns requires adaptation of the interlacing nozzles to varying operating conditions, for example the forwarding or feed speed of the yarn, the type or nature of the yarn, in other words, differences between crimped and smooth yarns, and also the cross-section or form of the individual filaments. Accordingly, as a general rule the number and positions of the air jets or blowing nozzles must be optimized by tests. The data obtained from these tests must be reproducible with a high degree of precision in order to avoid faulty production which sometimes arises even because of only very small deviations from the required settings.

Interlacing nozzles of the aforementioned type are shown and described, for example, in German Pat. No. 2,840,177 and in U.S. Pat. No. 2,995,801, granted Aug. 15, 1961.

SUMMARY OF THE INVENTION

Therefore, with the foregoing in mind, it is a primary object of the present invention to provide a new and improved construction of an apparatus for positively and reliably interlacing a multi-filament yarn or the like.

Another important object of the present invention aims at providing a new and improved construction of an apparatus for interlacing a multi-filament yarn which affords a certain degree of flexibility in setting the position of the air jet or blow nozzle, and thus the issuing air stream, in order to optimize the interlacing operation with respect to the momentarily encountered conditions, particularly the feed speed, nature and properties of the processed yarn and its constituent filaments.

Still a further significant object of the present invention is directed to an improved construction of an apparatus for interlacing multi-filament yarns in a highly reliable, efficient and controlled manner and which interlacing apparatus can be readily and easily adapted to the momentarily encountered conditions, such as feed speed of the yarn, type of yarn and cross-sectional shape of the individual filaments thereof.

Yet a further noteworthy object of the present invention concerns itself with providing a new and improved construction of an apparatus for interlacing multi-filament yarns, which interlacing apparatus is relatively simple in construction and design, highly reliable in operation, quite economical to manufacture, not readily subject to breakdown or malfunction, and requires a minimum of maintenance and servicing.

Now in order to implement these and still further objects of the invention, which will become more readily apparent as the description proceeds, and specifically in order to obtain a certain flexibility in the setting of the air jet or blow nozzle, and to at least partially avoid the aforementioned previously required high precision reproducibility during the manufacture of the individual parts of the interlacing apparatus, the invention contemplates arranging the air jet or blow nozzle such that it is adjustable within a predetermined operating range or region.

Certain of the more notable advantages achieved by the invention substantially reside in the fact that the optimal setting of the interlacing air jet or blow nozzle can be determined during operation of the interlacing apparatus and can be set immediately for such operation.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

Figure 8:
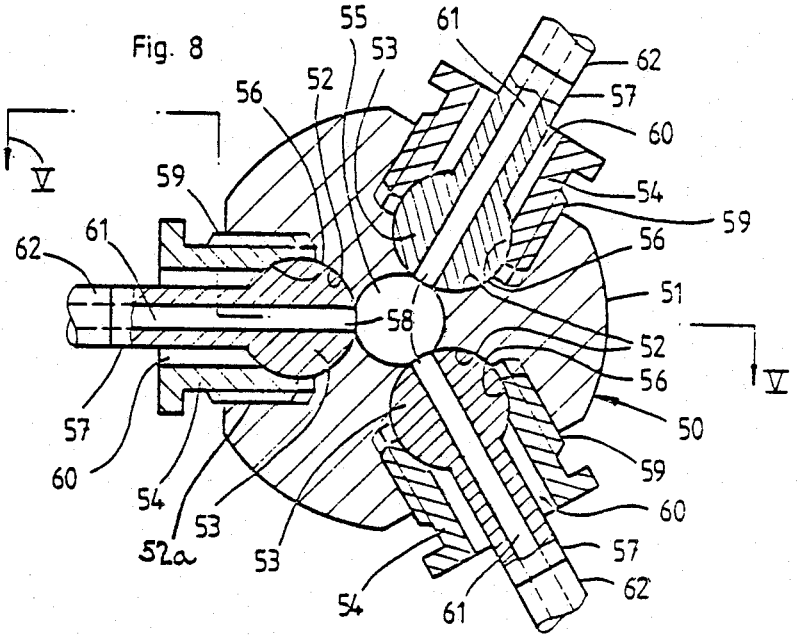
FIG. 8 shows a section essentially taken along the section line IV—IV of FIG. 9, through a further modification of the inventive interlacing apparatus, considerably enlarged and illustrated part schematically.

8, taken substantially along the section line V—V of such FIG. 8.

DETAILED DESCRIPTION OF THE PREFERRED EMBODIMENTS

Describing now the drawings, it is to be understood that to simplify the showing thereof only enough of the structure of the various exemplary embodiments of multi-filament yarn interlacing apparatus has been illustrated therein as is needed to enable one skilled in the art to readily understand the underlying principles and concepts of this invention. Turning attention now specifically to FIGS. 1 and 2 of the drawings and the therein illustrated exemplary embodiment of multi-filament yarn interlacing apparatus 1 for interlacing a multi-filament 2 in an interlacing passage or channel 3, such interlacing apparatus 1 will be seen to comprise a main portion or main housing part 4 and an attachment portion or attachment housing part 5 secured thereto. These two housing parts 4 and 5 enclose the interlacing passage or channel 3 and are appropriately held together by any suitable and therefore not particularly illustrated clamping or fixing elements, such as, for instance, clamping or fixing bolts.

In the main housing portion or part 4, a movable member, here shown in the form of a slide member or slider 6, is arranged transverse to the lengthwise direction of extent of the interlacing passage or channel 3 such that an air jet or blow nozzle 7, which extends transversely through this slide member or slider 6, opens into the interlacing passage or channel 3. In other words, the interlacing passage 3 defines a longitudinal axis and the blow nozzle 7 defines a transverse axis substantially intersecting the longitudinal axis to define a central plane.

At one of its ends this movable or displaceable slide member 6, which is, for instance, of substantially cylindrical shape, engages a compression spring 8 or equivalent force-transmitting element supported in the main housing part 4. This compression spring 8 or equivalent force-transmitting element applies an opposing force to the slide member 6 and thus to the blow nozzle 7 to assist in attaining its desired selected or positional adjustment. At its other end such slide member 6 engages a pressure pin or bolt 9. This pressure pin 9 is part of a screw or threaded bolt member 10 guided in the main housing part 4.

The slide member 6 is manufactured with respect to tolerances such that, in spite of the movable arrangement of the slide member 6, as little leakage air as possible can flow along the cylindrical circumference of such slide member 6 from a pressure air chamber or compartment 11 into the interlacing passage or channel 3.

This pressure air chamber 11 is provided on the side of the slide member 6 situated opposite to the interlacing passage or channel 3 and is fed with pressurized or compressed air by means of a pressure air connection 12 or the like. The pressurized or compressed air passes from the pressure air chamber 11 through the air jet or blow nozzle 7 into the interlacing passage or channel 3.

Figure 2:
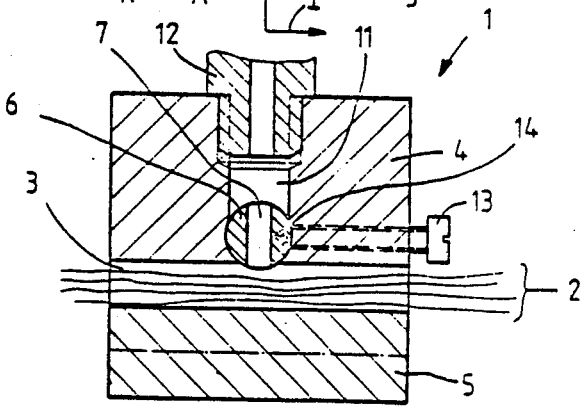
FIG. 2 shows a section through the interlacing apparatus depicted in FIG. 1, taken substantially along the section line I—I thereof.

Further, as shown in FIG. 2, the slide member 6 can be fixed by a positioning screw or bolt 13 in a selected position. For this purpose, such positioning screw or bolt 13 projects into a groove 14 provided in the slide member 6.

In order to determine during operation of the interlacing apparatus 1 an optimal position of the air jet or blow nozzle 7 for interlacing of a multi-filament or filaments 2, this air jet or blow nozzle 7 is appropriately positionally shifted by movement of the slide member 6 in the one or the other direction R (FIG. 1) within an operating range or region A until the desired interlacing of the multi-filament 2 is obtained. In the embodiment under discussion the slide member 6 and its blow nozzle 7 can be selectively positionally adjusted at least transversely with respect to the lengthwise axis of the interlacing passage 3, i.e. transversely or laterally of the operating range or region A shown in FIG. 1.

The term "operating range" or "operating region" of the air jet or blow nozzle 7 refers to that range or region within which the position of the air jet or blow nozzle 7 can be changed while still ensuring that this air jet or blow nozzle 7 continues to completely open into the associated interlacing passage or channel 3.

As can be best seen from FIG. 2, the positioning groove 14 is provided in such a manner that the air jet or blow nozzle 7 lies substantially at right angles to the interlacing passage or channel 3. It is, however, possible to arrange this groove 14 in such a manner that the air jet or blow nozzle 7 is disposed at a desired angle to the interlacing passage or channel 3, that is, for example, such that the air issuing from the air jet or blow nozzle 7 into the interlacing passage or channel 7 assists in moving the filaments 2 in a predetermined or desired forwarding or feed direction of the filaments 2.

Figure 3:
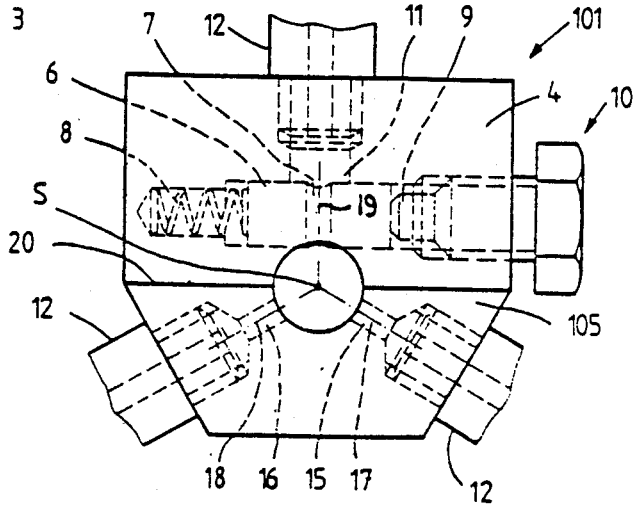
FIG. 3 shows a modification of the interlacing apparatus depicted in FIG. 1, enlarged to the same scale and schematically illustrated.

In the modified construction of interlacing apparatus 101 shown in FIG. 3, two further air jets 15 and 16 are provided in addition to the air jet or blow nozzle 7. These air jets or blow nozzles 15 and 16 are stationary and their axes of symmetry 17 and 18, respectively, substantially intersect the axis of symmetry S of the interlacing passage or channel 3 as best seen by referring to FIG. 3. An attachment portion or attachment housing part 105 serves to receive the air jets or blow nozzles 15 and 16 together with the related pressure air connections 12 required therefore. It is, of course, possible to also provide an arrangement wherein two of these three blow nozzles are movably adjustable and the remaining blow nozzle is stationary.

Due to the already mentioned adjustability or selective positionability of the blow nozzle 7, the axis of symmetry 19 thereof can now be set either at the point of intersection of the axes of symmetry 17 and 18, or in any other desired position, within the operating range A and within the adjustability of the position of the groove 14.

The axes of symmetry 17 and 18 of the air jets or blow nozzles is and 16 mutually enclose an angle of substantially 120°. In the event that the axis of symmetry 19 of the air jet or blow nozzle 7 passes through the point of intersection of the axes of symmetry 17 and 18, then the axes of symmetry 17 and 19 also substantially enclose an angle of 120°, as do the axes of symmetry 18 and 19.

The attachment housing part 5, and also the attachment housing part 105, are appropriately joined together in a substantially air-sealing or air-impervious manner at a separation or contact plane 20. Thus, there is provided the possibility of opening the interlacing passage or channel 3 for threading-in of the filaments 2. The device or facility for receiving the main housing part 4 and the attachment housing part 5 or 105, respectively, is, however, not subject matter of the present invention, and therefore need not be here further considered.

Figure 1:
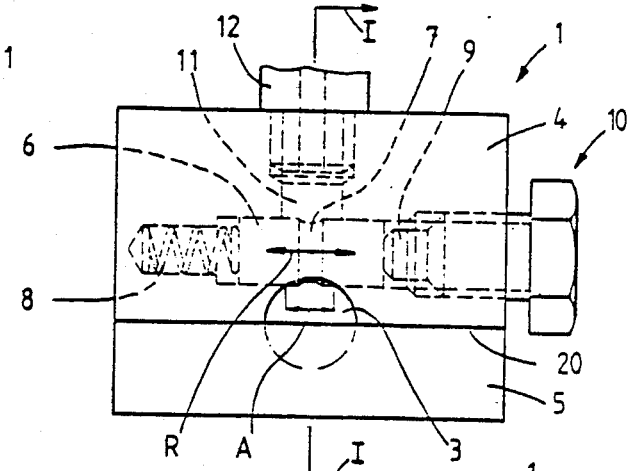
FIG. 1 is a plan view of a first exemplary embodiment of multi-filament yarn interlacing apparatus constructed according to the present invention, shown considerably enlarged and illustrated part schematically.

Finally, by way of completeness it is here mentioned that in the various embodiments of multi-filament yarn interlacing apparatuses 1 and 101 as depicted and described with reference to FIGS. 1, 2 and 3, identical components or parts have been generally indicated with the same reference numerals or characters.

Figure 4:
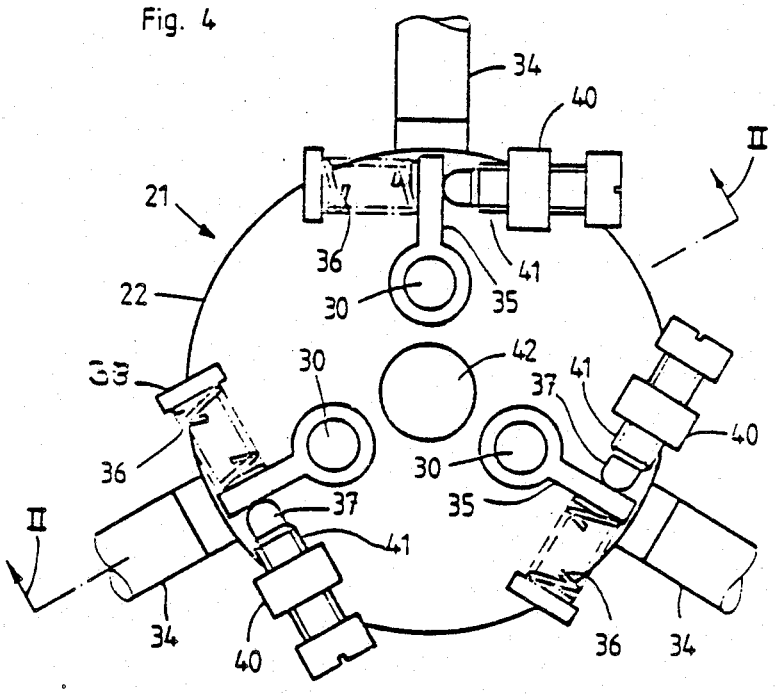
FIG. 4 shows a plan view of a further modification of the interlacing apparatus constructed according to the present invention, depicted considerably enlarged and illustrated part schematically.
Figure 5:
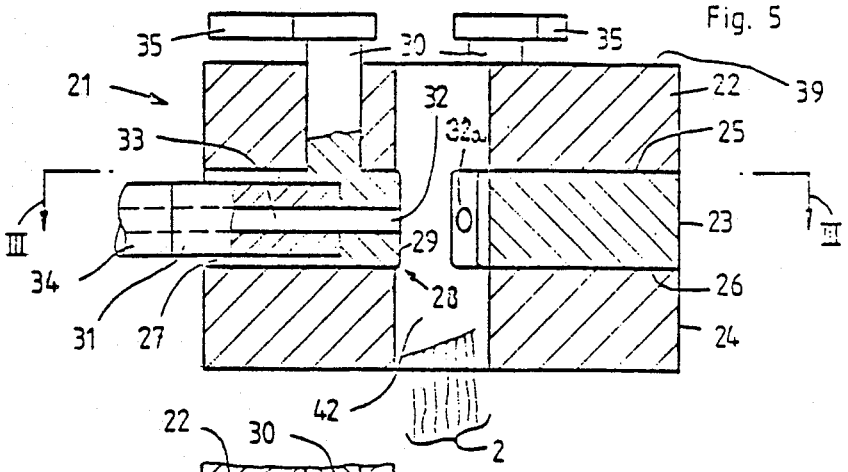
FIG. 5 shows a section through the interlacing apparatus depicted in FIG. 4, taken substantially along the section line II—II thereof.
Figure 6:
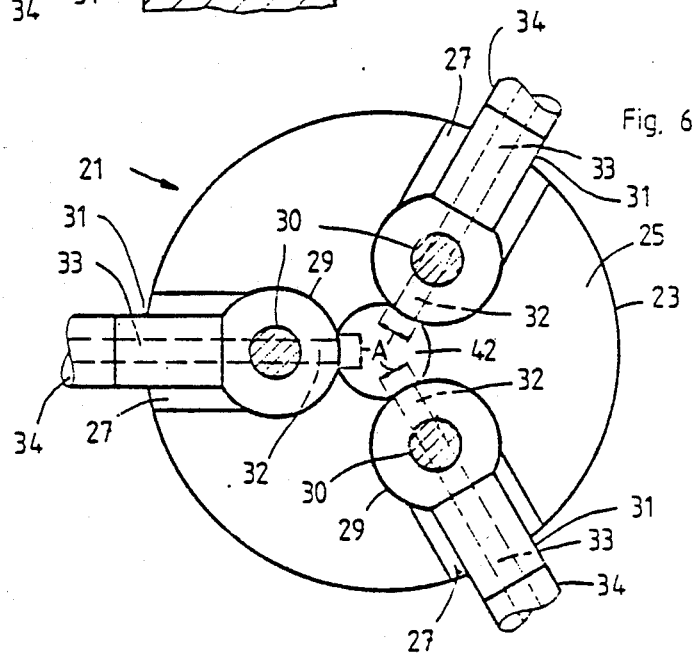
FIG. 6 shows a section through the interlacing apparatus of FIG. 5, essentially taken along the section line III—III thereof.

A further construction of interlacing apparatus 21 designed in accordance with the teachings of the present invention is shown in FIGS. 4 to 6 in which, in a so-called sandwich construction, an upper portion or upper housing part 22, an intermediate portion or intermediate housing part 23 and a lower portion or lower housing part 24 are fixedly secured together by means of any suitable connection or securing elements. These parts 22, 23 and 24 are secured together at the separation or contact planes 25 and 26.

In this connection it is to be understood that the terms "upper" and "lower" conveniently refer only to the representations shown in FIG. 5, and therefore otherwise have no specific relevance and are certainly not to be considered in any way as constituting limitations as concerns the positional disposition of the interlacing apparatus during its operation.

The intermediate portion or intermediate housing part 23 has three recesses or openings 27, each of which serve to receive an air jet or blow nozzle element 28.

Each air jet or blow nozzle element 28 comprises a substantially disc-shaped air jet or blow nozzle carrier 29 provided with a shaft 30 and a pressurized air infeed tube or conduit 31 equipped with a pressurized or compressed air infeed bore 33. The axis of rotation of each such blow nozzle carrier 29 is disposed substantially parallel to the interlacing passage or channel 42.

An air jet or blow nozzle 32 provided in the air jet or blow nozzle element 28 forms an extension of the pressurized air infeed bore 33 of the pressurized air infeed tube 31.

The air jet or blow nozzle carrier 29 is connected to any suitable compressed or pressurized air-feed element, not particularly shown, by means of a flexible connector tube 34.

An adjusting element, here shown in the form of an adjusting or adjustment lever 35, is fixedly connected to the free end of the related shaft 30 and, as shown in FIG. 4, can be moved by an associated compression spring 36 and a pressure pin or bolt 37 arranged opposite to each such related compression spring 36.

The compression spring 36 is secured at one of its ends to the associated adjusting or adjustment lever 35 and at its other end to an associated support plate 38. This support plate 38, in turn, is fixedly secured to the surface 39 (cf. FIG. 5) of the upper portion or upper housing part 22. Here also the compression spring 36 applies an opposing force to the associated adjustment lever 35 and thus to the associated blow nozzle 32 to assist in attaining its desired or selected positional adjustment.

A carrier or support member 40 provided with a not particularly visible screw-threaded bore serves to receive the associated pressure pin or bolt 37 which is provided with a corresponding screw-thread 41. Each such carrier or support member 40 is also fixedly connected to the aforementioned surface 39.

Furthermore, the embodiment of interlacing apparatus 21 under discussion with reference to FIGS. 4 to 6 will be understood to further comprise the interlacing passage or channel 42 into which projects each air jet or blow nozzle carrier 29 to such an extent that the outfeed mouth or opening **32*a* of the corresponding air jet or blow nozzle 32** is adjustable within the already described operating range or region A.

Figure 7:
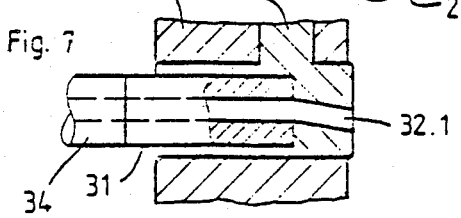
FIG. 7 shows in detail a modification of part of the interlacing apparatus depicted in FIGS. 4 to 6.

As shown in the further modification depicted in FIG. 7, in contrast to the arrangement of the air jet or blow nozzle 32 of the interlacing apparatus 21 of FIG. 5 at substantially right angles to the interlacing passage or channel 42, the therein depicted air jet or blow nozzle 32.1 can, for example, be arranged at an inclination to such interlacing passage or channel 42 in such a manner that the air flowing out of the air jet or blow nozzle 32.1 assists in moving the multi-filament 2 in its prescribed forwarding or feed direction.

In operation it is assumed that the axes of symmetry of the three air jets or blow nozzles 32 or 32.1, as the case may be, have a common point of intersection. If interlacing of the multi-filament yarn is inadequate or deviates from expectations, then the positions of the air jets or blow nozzles can be adjusted within the operating range A by adjusting the respective pressure pins or bolts 37 until the interlacing of the multi-filament 2 exhibits the desired degree of entanglement. One of the notable advantages of the herein described constructions of interlacing apparatuses depicted in FIGS. 4 to 7 resides in the possibility of selectively adjusting one, all or only two of the air jets or blow nozzles within the operating range A.

A further advantage of this triple adjustability of the air jets or blow nozzles also resides in the possibility of using the interlacing apparatuses for texturizing the yarn.

Figure 9:
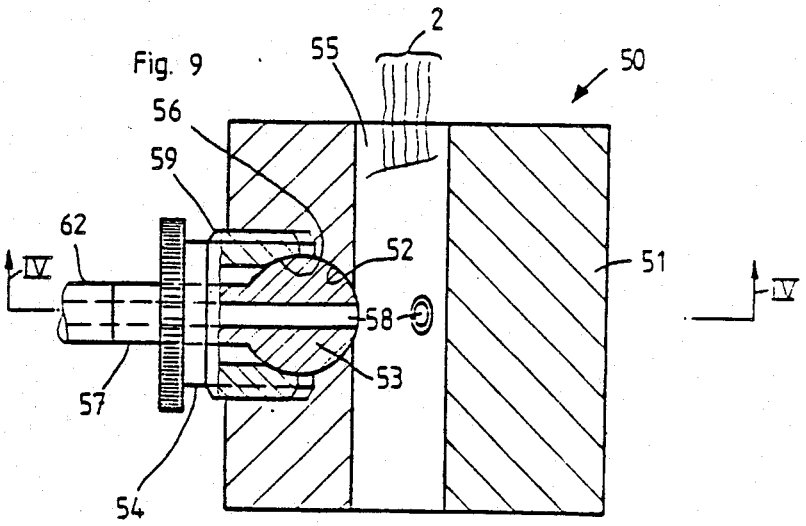
FIG. 9 shows a cross-section through the modified construction of interlacing apparatus depicted in FIG.

Two-dimensional adjustability of the air jets or blow nozzles is provided by the construction of interlacing apparatus 50 depicted in FIGS. 8 and 9. This embodiment of interlacing apparatus 50 comprises a block or body member 51 containing three substantially spherical recesses 52 arranged in the same plane, each such recess 52 serving to receive a respective substantially spherical or ball-shaped air jet or blow nozzle element or body 53 configured to fittingly correspond to its related recess 52.

Each spherical recess 52 is provided with a screw-threaded bore **52*a* disposed concentric therewith and which serves to receive a related securing or fixation member or part 54 provided with a corresponding external screw thread 59 and with a substantially cylindrical chamber 60. At the end of the cylindrical chamber 60 directed towards the interlacing passage or channel 55 provided centrally within the block or body member 51, there is provided a spherical surface or spherical surface portion 56 adapted to the spherical or ball-shaped air jet or blow nozzle element or body 53. Consequently, each air jet or blow nozzle element 53 can be securely clamped by means of the associated securing or fixation member 54 between its related spherical recess 52 and the spherical surface or spherical surface portion 56**, and thereby positively positionally secured.

The substantially ball-shaped or spherical air jet or blow nozzle element 53 also comprises a pressurized air infeed tube or conduit 57 provided with a pressure air-infeed bore 61 which opens as an air jet or blow nozzle 58 into the interlacing passage or channel 55. A connecting tube or conduit 62 connected to the pressurized or compressed air infeed tube 57 is, in turn, connected to any suitable pressurized or compressed air-feed element, which has not been particularly shown.

One of the notable advantages of this modification is that, during operation of such interlacing apparatus 50, the possibility exists of either positionally securing all three air jets or blow nozzles 58 in such a manner that their axes of symmetry intersect at a common point, or by virtue of the spherical movability of these air jets or blow nozzles 58 the aforementioned axes of symmetry can be positioned so as to assume any kind of deviation from such intersection point within an operating region shaped as a section of a sphere or ball. This operating region is defined in that, during movement of each air jet or blow nozzle at the borders of the operating region, the axis of symmetry describes the envelope of a cone, the axis of rotation of which lies substantially at right angles to the axis of symmetry of the interlacing passage or channel 55.

Finally, if the interlacing apparatus 21 or 50 is to be divided or separable in order to advantageously afford relatively easy or convenient threading-in of the multifilaments 2 into the associated interlacing passage or channel 42 or 55, as the case may be, then this can be accomplished in a manner similar to that illustrated and described with reference to the embodiments of FIGS. 1 and 3.

While there are shown and described present preferred embodiments of the invention, it is to be distinctly understood that the invention is not limited thereto, but may be otherwise variously embodied and practiced within the scope of the following claims.

Accordingly, what I claim is:

1. An interlacing apparatus for interlacing a multifilament yarn, comprising:

means defining an interlacing passage having a direction of forwarding the yarn;

at least one blow nozzle opening into said interlacing passage at a predetermined angle with respect thereto for infeeding of a pressurized fluid medium;

means cooperating with said at least one blow nozzle to enable adjustment of said at least one blow nozzle such that said at least one blow nozzle can be moved within a predetermined operating region;

said adjustment means for said at least one blow nozzle includes structure allowing said at least one blow nozzle to carry out a substantially circular movement;

said structure of said adjustment means of said at least one blow nozzle which enables said at least one blow nozzle to carry out a substantially circular movement comprises a substantially ball-shaped blow nozzle body; and said at least one blow nozzle being arranged in said substantially ball-shaped blow nozzle body such that an axis of symmetry of said at least one blow nozzle describes, during movement of the blow nozzle along boundaries of said predetermined operating region, the envelope of a cone having an axis of rotation which lies substantially at right angles to a predetermined axis of symmetry of the interlacing passage.

2. The interlacing apparatus as defined in claim 1, wherein:

said interlacing passage has a lengthwise direction of extent; and said substantially ball-shaped blow nozzle body enables adjustment of said at least one blow nozzle in a direction extending at least laterally of said predetermined operating region in the lengthwise direction of extent of said interlacing passage.

3. The interlacing apparatus as defined in claim 1, wherein:

said interlacing passage has a lengthwise direction of extent; and said substantially ball-shaped blow nozzle body enables adjustment of said at least one blow nozzle in a direction extending both transversely of said predetermined operating region and in a direction extending laterally of said predetermined operating region in the lengthwise direction of extent of said interlacing passage.

4. An interlacing apparatus for interlacing a multifilament yarn, comprising:

housing means defining an interlacing passage having a longitudinal axis;

said housing means defining at least one transverse passage intersecting said interlacing passage for introducing a pressurized fluid medium and having a transverse axis;

said transverse axis at least approximately intersecting said longitudinal axis to define conjointly therewith a central plane;

adjustable nozzle means provided in each said at least one transverse passage for forming a fluid jet of said pressurized fluid medium;

adjustment means for adjusting said adjustable nozzle means such that said fluid jet is moved in a direction extending transverse to said central plane;

said adjustable nozzle means comprises ball and socket means; and said adjustment means enabling said adjustable nozzle means to be pivotally adjusted such that said fluid jet is also moved in a direction extending substantially parallel to said central plane.

* * * * *